US007238145B2

(12) United States Patent
Robbins et al.

(10) Patent No.: US 7,238,145 B2
(45) Date of Patent: Jul. 3, 2007

(54) ORAL-LEVER RESISTANCE EXERCISE DEVICE

(75) Inventors: Jo Anne Robbins, Madison, WI (US); Jacqueline A. Hind, Madison, WI (US); Angela L. Hewitt, Minneapolis, MN (US)

(73) Assignee: Wisconsin Alumni Research Foundation, Madison, WI (US)

( * ) Notice: Subject to any disclaimer, the term of this patent is extended or adjusted under 35 U.S.C. 154(b) by 0 days.

(21) Appl. No.: 11/199,736

(22) Filed: Aug. 9, 2005

(65) Prior Publication Data

US 2007/0037665 A1 Feb. 15, 2007

(51) Int. Cl.
*A63B 23/03* (2006.01)
*A61H 1/00* (2006.01)
*A61B 1/32* (2006.01)

(52) U.S. Cl. ..... 482/11; 482/122; 482/128; 601/38; 600/237

(58) Field of Classification Search ..... 482/11, 482/121, 10, 31, 140, 124, 128; 601/38; D21/692, 693; 433/140; 600/237–239
See application file for complete search history.

(56) References Cited

U.S. PATENT DOCUMENTS

| | | | | |
|---|---|---|---|---|
| 10,635 | A * | 3/1854 | Haskins | 24/501 |
| 888,484 | A * | 5/1908 | Gehorsam | 600/219 |
| 2,483,305 | A * | 9/1949 | Vollenweider | 290/1 A |
| 2,573,125 | A * | 10/1951 | Wilks | 24/511 |
| 3,349,621 | A * | 10/1967 | Mullen | 73/379.03 |
| 3,497,216 | A * | 2/1970 | Jack | 482/122 |
| 3,813,096 | A * | 5/1974 | Welch | 482/11 |
| 4,280,696 | A * | 7/1981 | Ramon | 482/11 |
| 4,883,046 | A * | 11/1989 | Fontenot | 601/38 |
| 4,887,965 | A * | 12/1989 | Fox | 433/140 |
| 4,955,367 | A * | 9/1990 | Homsy | 601/38 |
| 5,213,553 | A | 5/1993 | Light | |
| 5,267,374 | A * | 12/1993 | Drake | 24/30.5 R |
| 5,562,105 | A * | 10/1996 | Syrop et al. | 128/845 |
| 5,746,703 | A * | 5/1998 | Levatino | 601/38 |
| 5,865,715 | A * | 2/1999 | Wallick | 482/124 |
| 6,050,961 | A | 4/2000 | Arnold | |
| 6,524,262 | B1 * | 2/2003 | Akihiro | 601/38 |
| 6,702,765 | B2 | 3/2004 | Robbins et al. | |
| 2003/0088158 | A1 * | 5/2003 | Chien | 600/237 |

* cited by examiner

*Primary Examiner*—Stephen R. Crow
*Assistant Examiner*—Allana Lewin
(74) *Attorney, Agent, or Firm*—Quarles & Brady LLP

(57) ABSTRACT

An oral exercise device that is portable, that has adjustable resistance and that allows the tongue to perform isotonic exercises in an environment that closely approximates the natural configuration of the tongue and the mouth to improve disorders of speech and swallowing.

15 Claims, 4 Drawing Sheets

ORAL-LEVER RESISTANCE EXERCISE DEVICE

CROSS-REFERENCE TO RELATED APPLICATIONS

STATEMENT REGARDING FEDEARALLY SPONSORED RESEARCH OR DEVELOPMENT

BACKGROUND OF THE INVENTION

The invention relates generally to an oral exercise device and a method of using the oral exercise device, and more particularly to an oral exercise device for the tongue.

The tongue and additional lingua musculature, like other muscles of the body, must be exercised in order to maintain muscle mass and strength. Failure to properly maintain muscle mass and strength of the tongue may lead to disorders such as dysphagia and dysarthria.

Difficulty in swallowing (dysphagia) and difficulty of speech (dysarthria) are common among all age groups, especially the elderly. Both difficulties may occur because of a natural loss of muscle mass and strength or may occur because of a secondary loss of muscle mass and strength following other conditions. One group of conditions includes damage to the nervous system, such as occurs in stroke, brain injury, spinal cord injury, Huntington's disease, Parkinson's disease, multiple sclerosis, amyotrophic lateral sclerosis (ALS or Lou Gehrig's disease), muscular dystrophy, cerebral palsy and Alzheimer's disease. Another group of conditions includes problems affecting the head and neck, such as cancer in the mouth, throat or esophagus; injury or surgery involving the head and neck; and decayed or missing teeth, or poorly fitting dentures. A final group of conditions includes other diseases, conditions or surgical interventions that affect the tongue or the nerves that innervate the tongue.

Dysphagia may be treated by a variety of procedures. For example, a subject may simply switch to a diet with specific food and liquid textures that are easier and safer to swallow. Alternatively, dysphagia may be attenuated or ameliorated by swallowing therapy, which may include special exercises for coordinating and strengthening the swallowing muscles or restimulating the nerves that trigger the swallow response.

Dysarthria may also be treated by a variety of procedures. For example, a subject may work with a speech-language pathologist to improve speech sounds. Alternatively, dysarthria may be altered by special exercises for coordinating and strengthening the speech muscles, particularly the tongue.

As applied to dysphagia and dysarthria, a number of devices and methods have been developed to exercise the tongue. For example, a clinician may simply have a subject press against a tongue depressor with his or her tongue. However, many subjects find a tongue depressor uncomfortable, and it can elicit a gag reflex. Also, a tongue depressor requires the assistance of a clinician, which can make it difficult to perform regular exercise of the tongue. Additionally, a tongue depressor is discarded after use, which creates waste. Finally, the pressure applied to the tongue by a tongue depressor is difficult to determine and pushing against a tongue depressor can be unsatisfying and provide little sense of progress to the subject.

U.S. Pat. No. 6,050,961 discloses a system designed to address the problems associated with a tongue depressor for treating dysphagia and dysarthria. The system utilizes a pair of planks and a pneumatic bulb positioned between the planks. The bulb is further coupled to a meter that can display the strength and the duration of force applied to the pneumatic bulb by a subject's teeth or tongue. While the bulb compresses slightly, the intent of this device is to measure a static force on the levers at a particular separation of the levers set by an adjustment plate. This system provides feedback to the user and is reusable, but is relatively complex, expensive, of limited durability or lifespan as the bulb punctures and changes elasticity, and ill-suited to regular use by a subject as part of an exercise regime.

U.S. Pat. No. 6,702,765, assigned to the same assignee as the present invention, and hereby incorporated by reference, discloses a system eliminating the pneumatic bulb and providing a compact electronic system for pressure measurement within a clinical setting.

BRIEF SUMMARY

The present invention provides an oral exercise device that is relatively inexpensive to manufacture and that can be easily given to a subject to be used as part of an exercise regime over a period of time. The device provides feedback to the subject in the form of mechanical compression of two levers together between the subject's tongue and hard palate, conditional to a predetermined opposing resistance that may be set by the subject without connection to external equipment.

Specifically, the present invention provides an oral exercise device to exercise the tongue, although it can also be used to exercise lips and jaw, which is comprised of an upper lever, a lower lever, a pivot between the upper lever and the lower lever and some form of resistance to the operation of the overall oral exercise device. Thus, the oral exercise device permits the subject to perform an isotonic and then isometric exercise as pressure is maintained with his or her tongue. To make the oral exercise device comfortable, the upper lever is designed to fit closely to the subject's hard palate, while the lower lever is designed to be adapted to the subject's tongue.

In one embodiment of the present invention, the oral exercise device is portable and constructed with a predetermined maximum force. The resistance element makes the oral exercise device portable by freeing the oral exercise device from external force and duration instrumentation. Additionally, the characteristics of the resistance element, preferably an elastic band or a spring, provide a predetermined amount of maximum force In another embodiment of the present invention, the oral exercise device has the resistance element outside the mouth. An advantage of placing the resistance element outside the subject's mouth is that it reduces the structures that need to be thoroughly cleaned because of exposure to the subject's saliva. Another advantage of placing the resistance element outside the mouth is that it precludes of the subject pinching his or her tongue in them.

In yet another embodiment of the present invention, the oral exercise device has adjustable resistance when the resistance element is an elastic band or a spring. An advantage of adjustable resistance is that it gives the oral exercise device a greater range of utility during a subject's therapy. In a preferred embodiment, the resistance element may be removable elastic bands, each with identical resistance, at the distal ends of the upper lever and the lower lever. In another preferred embodiment, the resistance element may be removable elastic bands, each with increasing resistance, at the distal ends of the upper lever and the lower lever. While it is contemplated that the elastic bands are preferably removable, it is also possible that the elastic bands could be integrated into the oral exercise device. Elastic bands are advantageous because they are easy to clean, easy to replace and may be used in MRI or fMRI studies.

Alternatively, the resistance element may be a spring, either a torsion spring or a compression spring, where the resistance to the operation of the oral exercise device is dependent upon the characteristics of the spring. Springs are advantageous because they are durable and may be integrated into the oral exercise device.

In a related embodiment of the present invention, the oral exercise device has resistance which can be altered simply by adjusting the placement of at least one elastic band on the upper lever and the lower lever. At least one notch or groove, but preferably multiple notches or multiple grooves, can be manufactured into the distal ends of the upper lever and the lower lever to accept an elastic band. A subject may alter the resistance by moving the elastic band from notch to notch or from groove to groove. Alternatively, if the upper lever and the lower lever are manufactured with a single notch or a single groove that can receive multiple elastic bands, the subject may alter the resistance by adding bands to the notch or to the groove.

In a further embodiment of the present invention, the oral exercise device is constructed so that the pivot fits tightly into the receiver by at least two mechanisms. In a preferred embodiment, the pivot is cylindrical and the receiver is a socket. In another preferred embodiment, the pivot is triangular and the receiver is manufactured to accept a tip of the triangle. An advantage of manufacturing a pivot on one of the levers that snaps into a receiver on the other lever is that the oral exercise device will be sturdier.

In another embodiment of the present invention, the oral exercise device provides a wide range of motion when the pivot is preferably located outside the subject's mouth. If the pivot is located near the middle of the upper lever or the lower lever, then the range of motion can be maximized as the pivot is not too close to the proximal end and is not too close to the resistance element.

In yet another embodiment of the present invention, the oral exercise device is inexpensive and biocompatible when it is manufactured from plastic.

In a further embodiment of the present invention, the oral exercise device provides feedback to the subject because a feedback element can be included on either the upper lever or the lower lever. When the subject pushes the upper lever and the lower lever together, the feedback element can alert the subject that a complete exercise has been achieved. Furthermore, the feedback element may provide a tactile sensation as well, such that a "click" may be sensed intraorally the subject achieves the goal.

In another embodiment of the present invention, the oral exercise device maintains proper alignment of the upper lever, the lower lever and the structures of the subject's mouth to obtain maximal benefit to the subject. In a preferred embodiment, the oral exercise device maintains proper alignment of the oral exercise device by the addition of a stabilizer running through the upper lever and the lower lever. An advantage of the stabilizer is that it prevents the upper lever and the lower lever from shifting relative to one another. In another preferred embodiment, the oral exercise device maintains proper alignment of the structures of the subject's mouth by the addition of bite blocks. An advantage of the bite blocks are that they promote the subject to actuate the oral exercise device with only the subject's tongue, rather than the jaw muscles.

In yet another embodiment of the present invention, the oral exercise device is a series of oral exercise devices, each with a different predetermined level of resistance, such as easy, medium and hard are contemplated. The subject uses the easy oral exercise device to strengthen the tongue at the easy level. Once the subject has successfully strengthened his or her tongue at the easy level, then he or she uses the medium oral exercise device until the tongue has been successfully strengthened at the medium level. Finally, the subject uses the hard oral exercise device until the tongue has been successfully strengthened at the hard level.

The foregoing and other objects and advantages of the invention will appear from the following detailed description. In the detailed description, reference is made to the accompanying drawings which form a part hereof and in which there is shown by way of illustration a preferred embodiment of the invention. Such embodiment does not necessary represent the full scope of the invention, however, and reference must be made to the claims herein for interpreting the scope of the invention.

BRIEF DESCRIPTION OF THE DRAWINGS

The invention will be better understood and the advantages other than those set forth above will become apparent when consideration is given to the following detailed description thereof. Such detailed description makes reference to the following drawings, wherein.

DETAILED DESCRIPTION OF THE INVENTION

Figure 1:
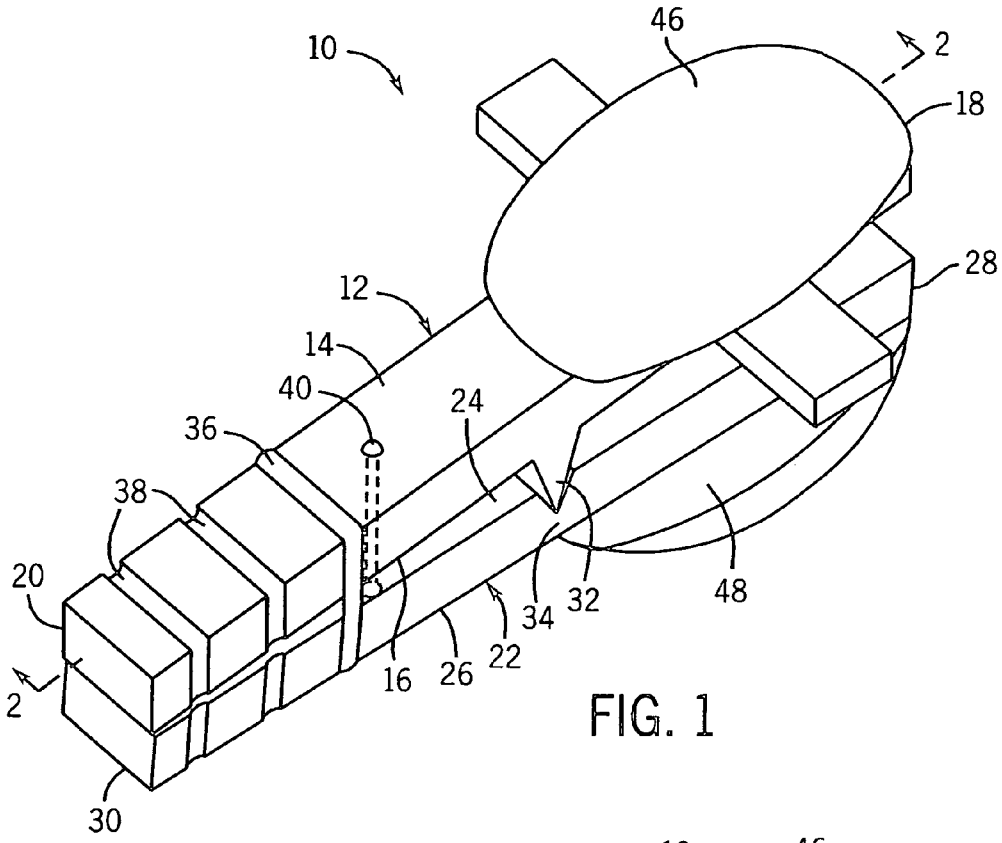
FIG. 1 is a perspective view showing one embodiment of the oral exercise device.

Referring to FIG. 1, in a preferred embodiment, the oral exercise device 10 of the present invention includes an upper lever 12 that has a superior surface 14, an inferior surface 16, a proximal end 18 and a distal end 20. Additionally, the oral exercise device 10 includes a lower lever 22 that has a superior surface 24, an inferior surface 26, a proximal end 28 and a distal end 30. The upper lever 12 and the lower lever 22 are preferably constructed of a stiff material, such as plastic. The upper lever 12 and the lower lever 22 are preferably rectangular and of equal length, sufficient to extend from a hard palate of a human subject to just outside a mouth of the subject. However, the upper lever 12 and the lower lever 22 may have rounded edges to increase the comfort to the subject. Finally, the upper lever 12 and the lower lever 22 are preferably of a width that is less than the width of the mouth of the subject to also increase the comfort to the subject.

A pivoting element 32 is located at least midway, and preferably outside the subject's mouth, between the proximal end 18 and the distal end 20 of the inferior surface 16 of the upper lever 12. Alternatively, the pivoting element 32 may be located at least midway, and preferably outside the subject's mouth, between the proximal end 28 and the distal end 30 of the superior surface 24 of the lower lever 22.

A pivoting element receiver 34 is located at least midway, and preferably outside the subject's mouth, between the proximal end 28 and the distal end 30 of the superior surface 24 of the lower lever 22, at a distance that is complimentary to the pivoting element 32 when the pivoting element 32 is on the upper lever 12. Alternatively, the pivoting element receiver 34 may be located at least midway, and preferably outside the subject's mouth, between the proximal end 18 and the distal end 20 on the inferior surface 16 of the upper lever 12, at a distance that is complimentary to the pivoting element 32 when the pivoting element 32 is on the lower lever 22.

Figure 5:
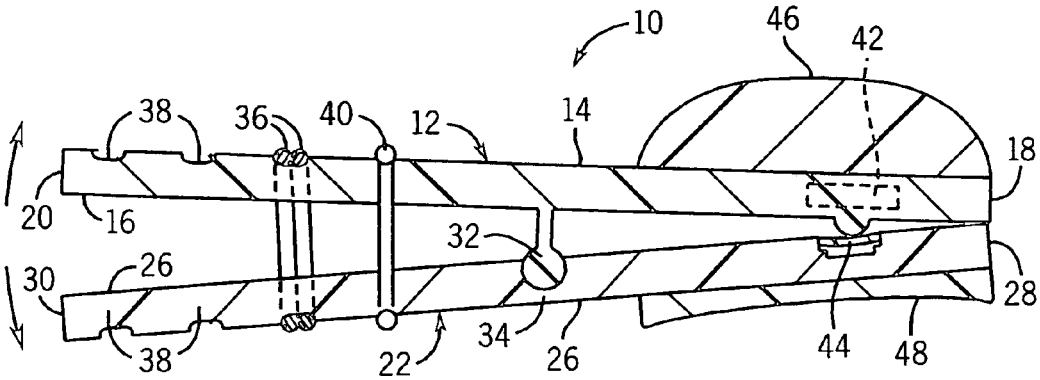
FIG. 5 is a side view of another embodiment of the oral exercise device.

As shown in FIG. 1, the pivoting element 32 may be triangular and the pivoting element receiver 34 a recess to receive a tip of the triangle. Alternatively, and as shown in FIG. 5, the pivoting element 32 may be cylindrical and the pivoting element receiver 34 a socket to receive the cylinder. The cylinder and socket arrangement can be manufactured whereby the cylinder snaps into the socket, helping to add even greater stability to the oral exercise device 10 during operation. Regardless of the shape, the pivoting element 32 and pivoting element receiver 34 are preferably molded into the upper lever 12 and the lower lever 22, and thus made of the same material as the upper lever 12 and the lower lever 22.

Figure 3:
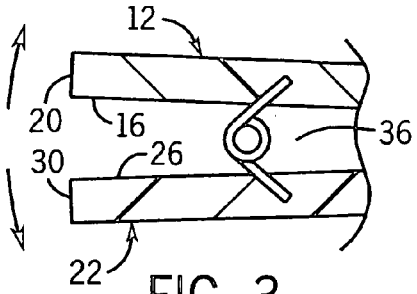
FIG. 3 is a partial side view of another embodiment of the oral exercise device showing a torsion spring as the resistance element.
Figure 4:
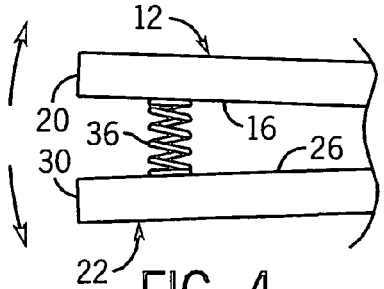
FIG. 4 is a partial side view of another embodiment of the oral exercise device showing a compression spring as the resistance element.

Referring again to FIG. 1, a resistance element 36 may be removably attached to at least one resistance element receiver 38 that encircles both the upper lever 12 and the lower lever 22. The resistance element receiver 38 need be no more than a notch or a groove with a width and depth that fits the resistance element 36 in the upper lever 12 and in the lower lever 22. The resistance element 36 is preferably at least one elastic band, though the resistance element 36 may also be a spring. As shown in FIG. 3, the spring may be a torsion spring. Alternatively, and as shown in FIG. 4, the spring may be a compression spring. Furthermore, it is contemplated that the resistance element 36 could be an elastic material attached between the inferior surface 16 of the upper lever 12 and the superior surface 24 of the lower lever 22.

As shown in FIG. 5, when the resistance element 36 is an elastic band, it may be more than one elastic band, which are sequentially added to at least one resistance element receiver 38 to increase the level of resistance. The multiple elastic bands could either be of the same thickness or of gradually increasing thickness to widen the range of resistance.

As shown in FIG. 3, when the resistance element 36 is a torsion spring, the ends of the spring may be also be integrated into the oral exercise device 10. However, the ends of the spring may be manufactured to removably attach to the resistance element receiver 38.

Alternatively, and as shown in FIG. 4, when the resistance element 36 is a compression spring, one end of the spring is attached by an adhesive or integrated into to the inferior surface 16 of the upper lever 12, while the other end of the spring would be attached by an adhesive or integrated into the superior surface 24 of the lower lever 22.

Referring again to FIG. 1, the oral exercise device 10 may include a stabilizer 40. The stabilizer 40 should preferably be in the form of a cylindrical rod running through the upper lever 12 and the lower lever 22. The stabilizer 40 can be constructed of the same material as the upper lever 12 and the lower lever 22, with the ends of the stabilizer 40 possessing threading, such that the stabilizer 40 can be capped with ends that screw onto it. The stabilizer 40 is preferably used when the resistance element 36 is a spring. The stabilizer 40 should function to prevent twisting or turning of the upper lever and the lower lever, yet should slide between the upper lever and the lower lever so as not to interfere with an exercise.

To further aid in stabilizing the oral exercise device 10, bite blocks 42 that extend radially from the upper lever 12 to a distance that is not wider than the mouth of the subject, but should extend far enough to fit comfortably between the subject's molars. The bite blocks 42 should be constructed of the same material as the upper lever 12 and the lower lever 22 and preferably molded into the upper lever 12.

Continuing to refer to FIG. 1, the oral exercise device 10 may also include a hard-palate adaptor 46 attached to the superior surface 14 of the proximal end 18 of the upper lever 12. The hard-palate adaptor 46 is preferably constructed from any material that is comfortable and can assume the shape of a subject's hard palate. For example, the hard-palate adaptor 46 constructed from dental putty so that it may be custom-molded provides a comfortable fit within a subject's mouth. The hard-palate adaptor 46 may also be constructed from material similar to that used for mouth guards, as described in U.S. Pat. No. 2,827,899, such that a custom fit to the subject's hard palate can be achieved. The hard-palate adaptor 46 is attached to the superior surface 14 of the upper lever 12 by an adhesive or similar material, though the hard-palate adaptor 46 may be screwed into the upper lever 12 or even molded into the upper lever 12.

Continuing to refer to FIG. 1, the oral exercise device 10 may further include a tongue adaptor 48 fastened by an adhesive or screw to the inferior surface 26 of the proximal end 28 of the lower lever 22. The tongue adaptor 48 can be constructed from any material that will conform to the surface of a subject's tongue. For example, the tongue adaptor 48 constructed from a plastic that is rigid yet comfortable for the subject meets this need. The tongue adaptor 48 can also be constructed from material similar to that used for mouth guards, as described in U.S. Pat. No. 2,827,899, such that a custom fit to a subject's tongue can be achieved. Alternatively, the tongue adaptor 48 could be molded into the lower lever 22 and would be constructed from the same material. Furthermore, the surface of the tongue adaptor 48 can be roughened to better enable the tongue to grip the tongue adaptor 48.

Figure 2:
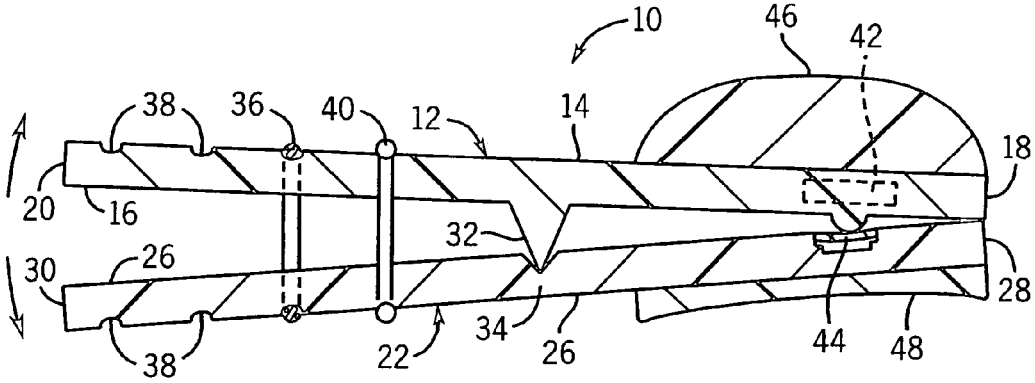
FIG. 2 is a side view of the oral exercise device in FIG. 1.

Referring now to FIG. 2, the oral exercise device 10 may further include a feedback element 44, which may be fastened by an adhesive or similar material near the proximal end 18 of the upper lever 12 or near the proximal end 28 of the lower lever 22. It is also acceptable to fasten the feedback element 44 with a screw. As one example, the feedback element 44 can be constructed from any material that will emit a sound when it comes into contact with another surface. Additionally, the feedback element 44 may also be constructed to produce a tactile sensation during operation of the oral exercise device 10 that can be sensed by the subject. Suitable materials for the feedback element 44 include, but are not limited to metal or plastic shaped like a disc, whereby the convex surface faces either the lower lever 22 when attached to the upper lever 12 or the upper lever 12 when attached to the lower lever 22.

Figure 6A:
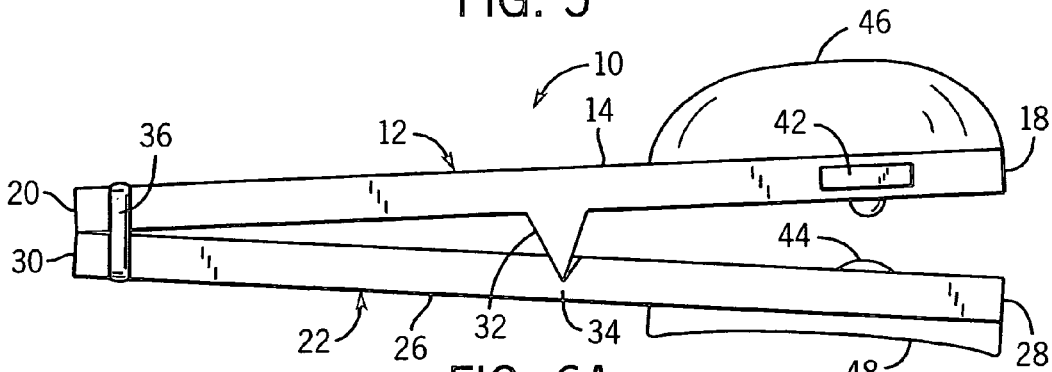
FIG. 6 is a side view of a series of oral exercise devices with elastic bands having increasing resistance.
Figure 6B:
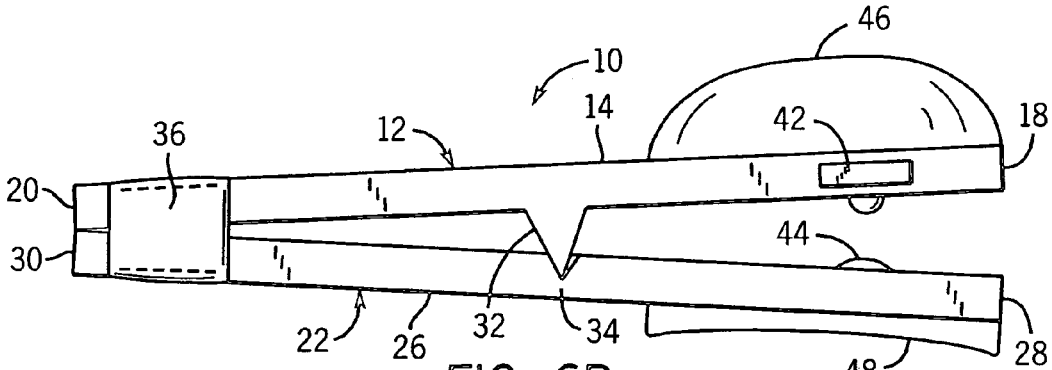
Figure 6C:
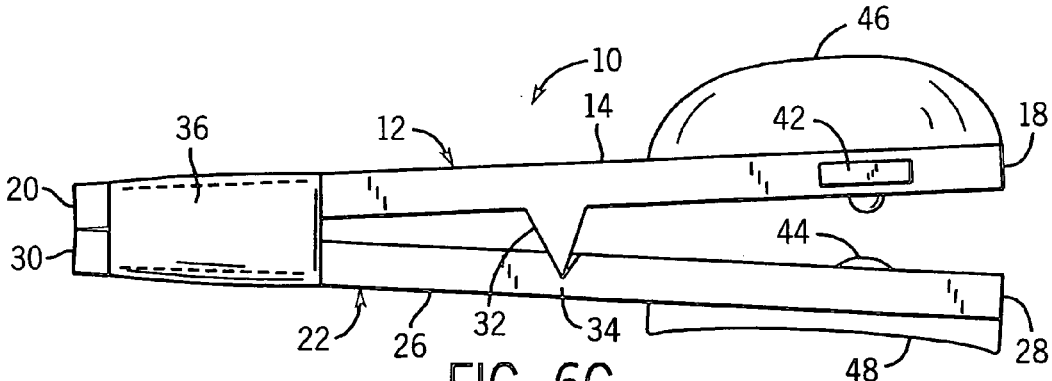
Figure 7A:
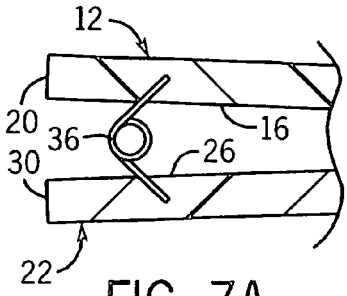
FIG. 7 is a partial side view of a series of oral exercise devices with torsion springs having increasing resistance.
Figure 7B:
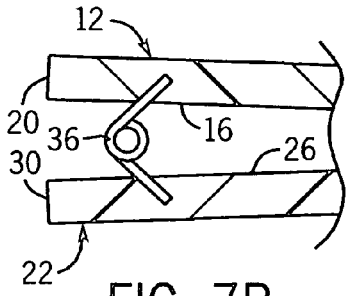
Figure 7C:
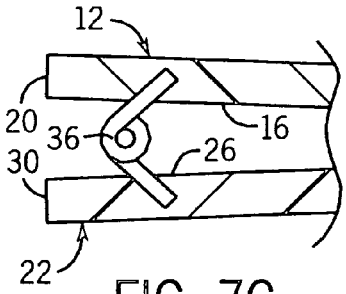
Figure 8A:
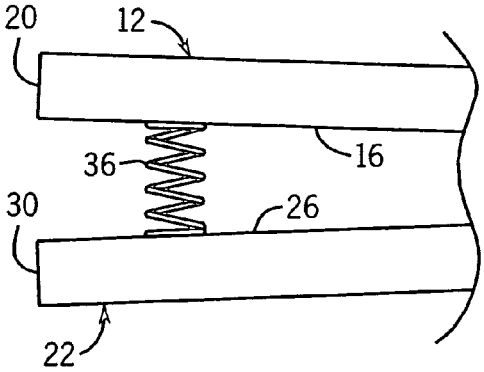
FIG. 8 is a partial side view of a series of oral exercise devices with compression springs having increasing resistance.
Figure 8B:
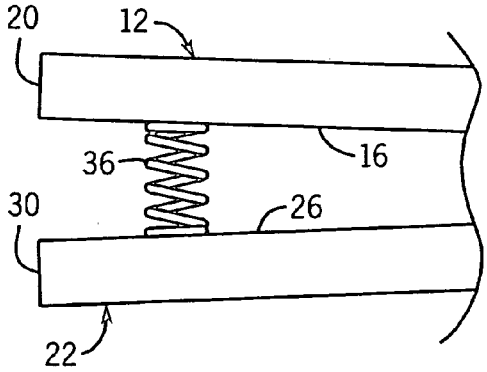
Figure 8C:
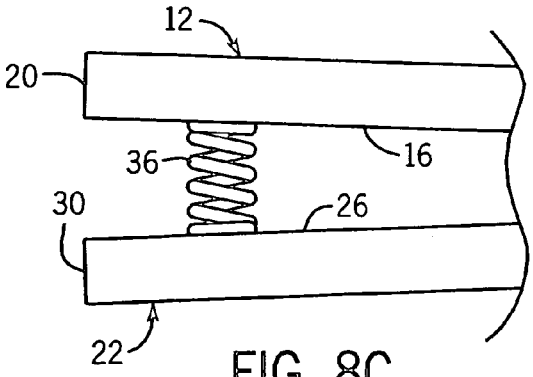

Referring now to FIG. 6, FIG. 7 and FIG. 8, the oral exercise device 10 may be series of oral exercise devices, each with a resistance element 36 having a gradually increasing level of resistance. As shown in FIG. 6, the resistance element 36 may be elastic bands of increasing resistance. Alternatively, and as shown in FIG. 7, the resistance element 36 may be torsion springs of increased resistance. Finally, and as shown in FIG. 8, the resistance element 36 may be compression springs of increasing resistance.

Figure 9:
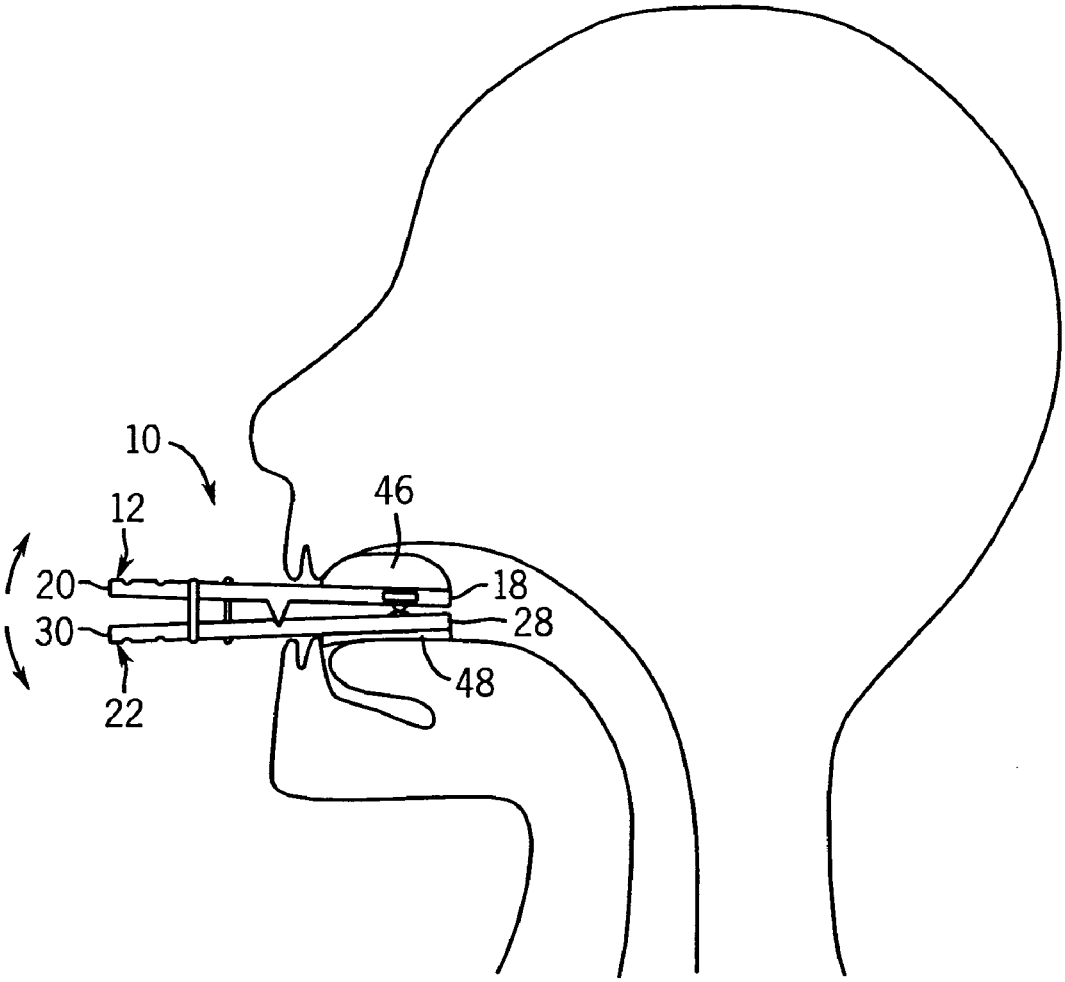
FIG. 9 is a side view of a human subject demonstrating the positioning of the oral exercise device during operation.

In operation, and now referring to FIG. 2 and FIG. 9, the proximal ends 18, 28 of the upper lever 12 and the lower lever 22 are inserted into the subject's mouth. At this position, the proximal ends 18, 28 of the upper lever 12 and the lower lever element 22 are a mutually separated position. The subject then pushes upward on the inferior surface of the lower lever element 22 with his or her tongue. If a tongue adaptor 48 is present on the lower lever element 22, then the subject pushes upward on the tongue adaptor 48. The resistance element 36 provides the resistance to a force applied by the subject's tongue. The lower lever element 22 is pushed upwards until the feedback element 44 emits a sound. As shown in FIG. 9, at this position the proximal ends 18, 28 of the upper lever element 12 and the lower lever element 22 are now in a mutually adjacent position. The subject may then relax his or her tongue, allowing the proximal ends 18, 28 of the upper lever element 12 and the lower lever element 22 to return to the mutually separated position and repeat the exercise.

The above description has been that of a preferred embodiment of the present invention, it will occur to those that practice the art that many modifications may be made without departing from the spirit and scope of the invention. In order to apprise the public of the various embodiments that may fall within the scope of the invention, the following claims are made.

We claim:

1. An oral exercise device comprising:

an upper lever having a proximal end and a distal end;

a lower lever also having a proximal end and a distal end;

a rigid stabilizer through the upper lever and the lower lever, whereby the stabilizer prevents the upper lever and the lower lever from misaligning;

a pivot between the upper lever and the lower lever, whereby the proximal ends of the upper lever and the lower lever move between a mutually separated position and a mutually adjacent position within a human mouth between a hard palate and a tongue, and whereby the distal ends of the upper lever and the lower lever likewise move between a mutually separated position and a mutually adjacent position in a manner opposite the proximal ends outside the human mouth;

a tongue adaptor stably fastened to the lower lever, wherein the tongue adaptor conforms to a subject's tongue and causes the subject to actuate the oral exercise device with only the subject's tongue;

bite blocks extending distally from and perpendicularly to the proximal end of said upper lever, whereby the bite blocks engage with the user's teeth to cause the subject to actuate the oral exercise device with only the subject's tongue; and at least one resistance element providing an isotonic resistance over a range of motion as the proximal ends move from the mutually separated position to the mutually adjacent position.

2. An oral exercise device as recited in claim 1, wherein the resistance element permits the distal ends of the upper lever and the lower lever to move to the mutually adjacent position to provide a predetermined maximum force that may be applied by the tongue.

3. An oral exercise device as recited in claim 1, wherein the resistance element is outside the mouth.

4. An oral exercise device as recited in claim 1, wherein the resistance element is adjustable.

5. An oral exercise device as recited in claim 1, wherein the resistance element is at least one elastic band.

6. An oral exercise device as recited in claim 1, wherein the resistance element is at least one spring.

7. An oral exercise device as recited in claim 1, further comprising a notch or a groove around the distal ends of the upper lever and the lower lever and sized to receive the resistance element.

8. An oral exercise device as recited in claim 1, further comprising at least one notch or at least one groove successively spaced around the distal ends of the upper lever and the lower lever and sized to receive the resistance element.

9. An oral exercise device as recited in claim 1, further comprising a pivot receiver located on a superior surface of the lower lever when the pivot is located on an inferior surface of the upper lever.

10. An oral exercise device as recited in claim 1, further comprising a pivot receiver located on the inferior surface of the upper lever when the pivot is located on the superior surface of the lower lever.

11. An oral exercise device as recited in claim 9, wherein the pivot is a cylinder and the pivot receiver is a socket, such that the pivot and pivot receiver snap together.

12. An oral exercise device as recited in claim 1, wherein the pivot is located midway on either the upper lever or the lower lever and the distal ends of the upper lever and the lower lever are outside the mouth.

13. An oral exercise device as recited in claim 1, wherein the upper lever and the lower lever are manufactured from a plastic.

14. An oral exercise device as recited in claim 1, further comprising a feedback element on either the upper lever or the lower lever, whereby the feedback element alerts a subject when the upper lever and the lower lever are in the mutually adjacent position.

15. An oral exercise device as recited in claim 1, further comprising a series of oral exercise devices, wherein the resistance element of each oral exercise device gradually increases in resistance.

* * * * *